United States Patent [19]

Schneider

[11] Patent Number: 4,924,952

[45] Date of Patent: May 15, 1990

[54] DETONATING HEADS

[76] Inventor: John L. Schneider, Beech Wood Place, West Hill, Skene, Aberdeenshire, United Kingdom

[21] Appl. No.: 288,037

[22] PCT Filed: Jun. 19, 1987

[86] PCT No.: PCT/GB87/00430

§ 371 Date: Dec. 16, 1988

§ 102(e) Date: Dec. 16, 1988

[87] PCT Pub. No.: WO87/07925

PCT Pub. Date: Dec. 30, 1987

[30] Foreign Application Priority Data

Jun. 19, 1986 [GB] United Kingdom ..... 8614911
Jul. 23, 1986 [GB] United Kingdom ..... 8617971

[51] Int. Cl.[5] ..... E21B 43/116

[52] U.S. Cl. ..... 175/4.54; 166/55; 175/4.52; 175/4.56

[58] Field of Search ..... 175/4.54, 4.56, 4.53, 175/4.52; 166/297, 299, 55, 55.1

[56] References Cited

U.S. PATENT DOCUMENTS 3,800,705 4/1974 Tamplen ..... 175/4.54 X
4,544,034 10/1985 George ..... 175/4.54 X
4,610,312 9/1986 Nelson et al. ..... 175/4.54 X
4,650,010 3/1987 George et al. ..... 175/4.54 X

FOREIGN PATENT DOCUMENTS 0184377 6/1986 European Pat. Off. .
2542804 9/1984 France .

*Primary Examiner*—Stephen J. Novosad
*Attorney, Agent, or Firm*—Florence U. Reynolds

[57] ABSTRACT

A detonating head assembly (30) for detonating perforating guns in an oil, gas or water well, comprises a retrievable detonating head (34), a landing sleeve (50) and a stinger (42). The detonating head (34) comprises a plunger assembly (36) slidably receivable within the sleeve (50) and including a plunger (64) releasable retaining at its lower end a piston (94) reciprocable within a housing (92), the piston (94) when released being actuable by hydrostatic pressure to detonate a detonating assembly (40), and latching dogs (58) co-operating with a recess (56) and with formations on the plunger (64) such that in a first, insertion position the detonating head (34) may be inserted into the sleeve (50), until the dogs (58) engage in the recess. Subsequent depression or withdrawal of the plunger (64) relative to, respectively, lower firing position or an upper firing position, releases the piston (94) permitting it to advance under the action of hydraulic pressure to activate the detonating assembly (40), while positioning the plunger (64) to ensure the dogs (56) remain engaged during detonation. Withdrawal of the plunger (64) to an uppermost position releases the dogs (58) and allows the detonating head (34) to be withdrawn from the landing sleeve (50) and be brought to the surface.

16 Claims, 5 Drawing Sheets

2/5

18
118
115
116
18
34
66
120
64
58
68
30
90
90b
70
56
88
88a
72
88b
74
36
76
60
78
50
82
84
86
62
54
32
80
106
96
97
104
108
94
38
92
102
98
100
112
110
40
114
48
46
52
44
32
42

DETONATING HEADS

This invention relates to a detonating head which is retrievable from the well before or after it has been mechanically actuated to fire one or more perforating heads Known detonating heads cannot be retrieved from the well in case of malfunction, to allow shot detection or for safety reasons if firing is to be deferred. It is an aim of the present invention to provide a detonating head which is retrievable and which allows the incorporation of various safety features.

According to the present invention there is provided a detonating head for detonating one or more perforating guns positioned in an oil, gas or water well, comprising a firing member reciprocable therein and arranged to be driven to detonate a detonating assembly, characterized in that the head further comprises restraining means for restraining the firing member against a driving force until the restraining means are disengaged mechanically.

According to a preferred aspect of the present invention there is provided a detonating head assembly for detonating one or more perforating guns positioned in an oil, gas or water well, the assembly comprising a retrievable detonating head, a landing sleeve and a stinger connectable thereto for communicating the explosion initiated by the detonating head to the perforating gun, said retrievable detonating head comprising a plunger assembly slidably receivable within said sleeve and including a plunger releasably retaining at its lower end a firing member drivable to detonate a detonating assembly, and latching means arranged to cooperate with engagement means at the upper end of said sleeve and with formations on the plunger such that in a first, insertion position of the plunger relative to said plunger assembly the detonating head may be inserted into said sleeve, until the latching mechanism engages the engagement means thereon; subsequent depression or withdrawal of the plunger relative to said detonating head and landing sleeve to, respectively, a second, lower firing position or to a third, upper firing position, releases said firing member permitting it to be driven to activate the detonating assembly, while positioning the latching mechanism to retain the detonating head within the sleeve against the detonation; and relative movement of the plunger to a fourth, retrievable position releases the latching mechanism to allow the detonating head to be withdrawn from the landing sleeve and be brought to the surface for inspection.

The latching mechanism is preferably constituted by longitudinally-extending dogs each having a radially outer abutment which in the firing positions is caused to project into a recess in the landing sleeve by engagement with respective lands on the plunger. Alternating with the lands are grooves in which an inner projection of the or each dog is respectively received when the plunger is in the first, insertion and fourth, retrieval positions.

Preferably the detonating head also comprises a shear pin which must be sheared when the plunger head is struck to move it to the second position or pulled to move it to the third position. The limits to the depression or withdrawal movements are preferably set by the engagement of a release shear pin mounted on the plunger housing with the respective ends of an axial slot in the plunger, the shear pin having to be sheared by movement of the plunger to the fourth, retrieval position.

The firing member of the detonator may be arranged to be driven by mechanical force applied, for example, to the plunger head. Alternatively, the firing member may comprise a piston reciprocable within a piston housing of said detonating head the arrangement being such that said piston is drivable within said piston housing by well hydrostatic pressure.

The detonating head assembly according to the present invention affords the following advantages.

(1) The detonating head can be run into the firing position by means of a slick-line or wire-line run after the perforating guns have been positioned at the correct depth, allowing the operators to run the guns without a detonating head in place at the time of running the guns.

(2) The detonating head assembly can be run simultaneously with the perforating guns, a can most commercial detonating heads.

(3) The detonating head can be retrieved after perforation by pulling on the plunger and shearing the release pin.

(4) The detonating assembly can be activated by pulling or pushing with the wire-line tool string or by dropping a bar from the surface, either in free fall mode or in controlled mode on a wireline.

(5) The detonating piston may be actuated by hydrostatic pressure, the value of which can be selected by changing a safety pin. As a minimum hydrostatic pressure is required to operate the piston, the detonating head cannot accidentally be detonated on the surface.

(6) By allowing retrieval of the detonating head from the well:

(a) The operator is enabled to retrieve the perforating guns from the well without the detonating head being attached to them.

(b) It can be established positively whether the detonating head has functioned properly or not.

(c) The detonating head may be replaced by another detonating head in the event of malfunction.

It has been found that, under some circumstances arising during oil well perforating procedures, it may be desirable to deactivate the detonating head while it is still downhole, and it is a further aim of the present invention to provide this facility.

According to another aspect of the present invention there is provided a detonating head comprising a detonating piston having mounted thereon a detonating pin arranged to strike a detonating assembly, a housing in which the piston is slidably received and which defines with the end of the piston remote from said pin a well fluid pressure chamber and with the end of the piston nearer said pin an atmospheric pressure chamber, the piston being urged in the striking direction by the difference in well fluid pressure over atmospheric pressure and being normally restrained in a retracted position by restraining means which are releasable to allow the piston to advance in the striking direction under the action of said pressure difference to fire the detonating assembly, and de-activating means which are actuable to allow communication between said chambers and the consequent equalization of said pressure difference to render the detonating piston inoperable.

Preferably the deactivating means comprise at least one weak point or membrane in the housing which is rupturable by application of pressure into the well.

Figure 1:
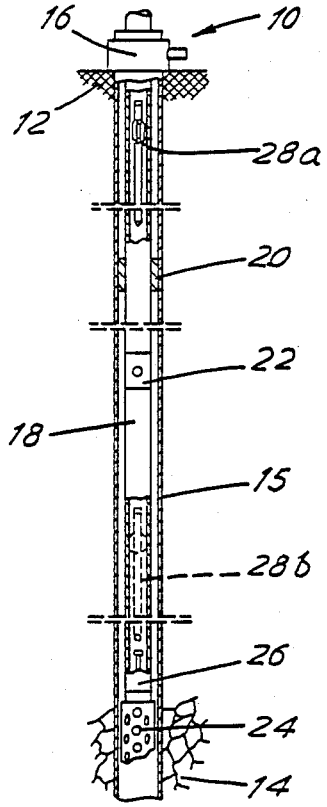
FIG. 1 is a diagrammatic longitudinal section through lengths of an oil, gas or water well showing the relationship of a retrievable detonating head assembly of the present invention to the other elements of the well.

FIG. 1 shows diagrammatically an oil or gas well 10 drilled into the earth's crust 12 into an oil bearing formation 14 and comprising a casing 15 capped by a well head 16 and within which is run a tubing or pipe string 18. The annular space between the string 18 and the casing 15 may be sealed by a packer 20 and the string 18 is provided with a production vent at 22. Tubing conveyed perforators 24 are secured to the bottom end of the string 18 and surmounted by a detonating head assembly 26 shown in the process of being mechanically activated by a detonating bar 28 shown at the surface in full line as **28*a* and near the bottom of the well in dashed line as 28*b***.

Figure 2:
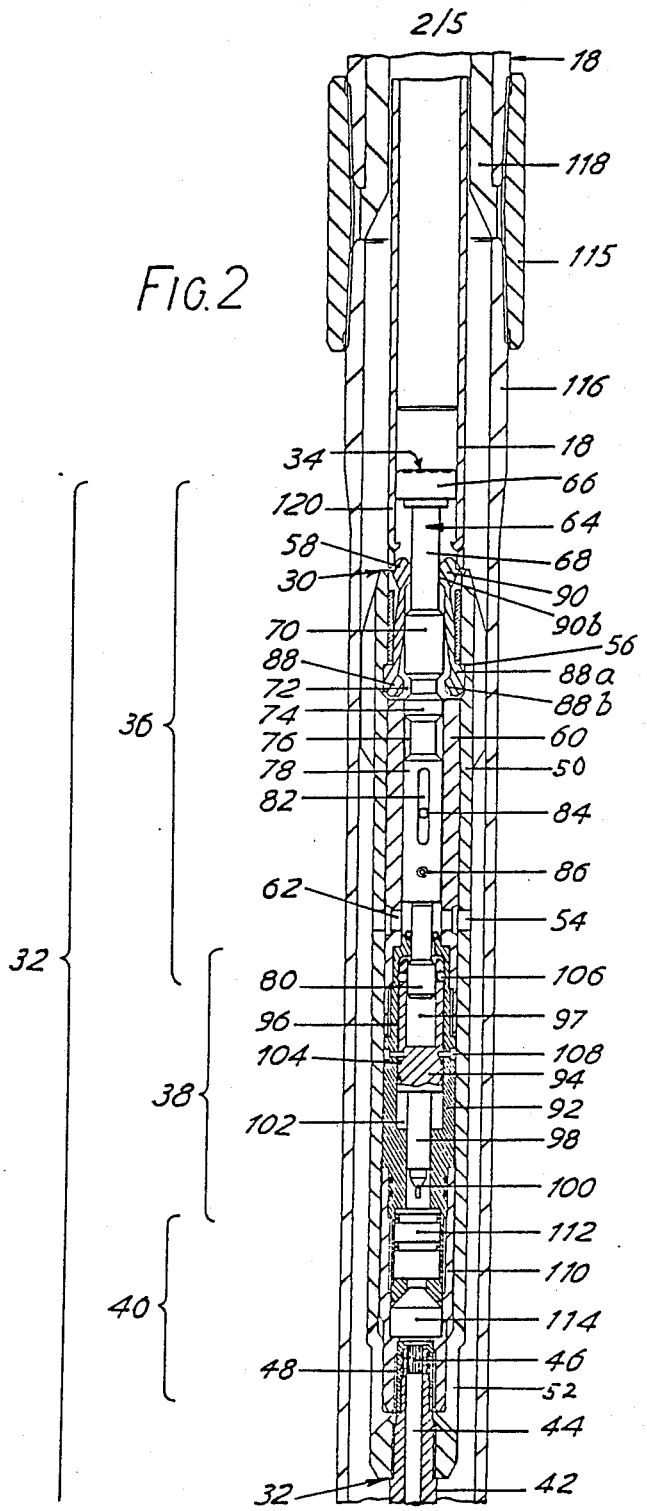
FIG. 2 is a longitudinal section through a first embodiment of the invention in the pre-firing position.
Figure 3:
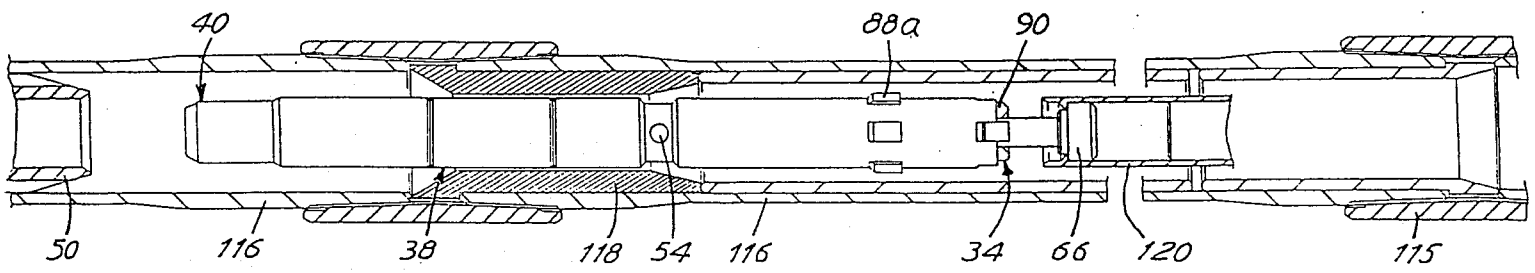
FIGS. 3 to 8 are each a longitudinal section generally corresponding to FIG. 2 and showing other stages in the operation of the detonating head assembly.

There now follows with reference to FIG. 2 a description of a detonating head assembly 30 (first embodiment) which comprises (I) Stinger and landing sleeve assembly 32, and (II) Retrievable detonating head 34 made up of A. Activating plunger and latching mechanism assembly 36;

B. Detonating piston and chamber assembly 38; and,

C. Detonator assembly 40.

(I) The stinger 42 is a steel tube of variable length fastened to the perforators 24 by means of a special adapter sub (not shown). It contains a detonating cord (primacord) 44 and a booster 46 at the top end. The stinger 42 communicates the explosion initiated by the detonating head 34 into the perforators 24, and is sealed against, well fluids by stinger cap 48.

The landing sleeve 50 screws onto the stinger 42 and has fill displacement ports 52 in its lower end to allow solids to be evacuated as the detonating head 34 enters the sleeve 50, and hydrostatic ports 54 in its central section; it also has in its upper section internal recesses 56 engageable with the latching dogs 58 in a manner to be described to secure the detonating head 34 in its place.

(II)A The activating plunger and latching mechanism assembly 36 comprises a plunger housing 60 slidably receivable within the landing sleeve 50 and having hydrostatic ports 62 in register with the ports 54. Reciprocable within the housing 60 is a plunger 64 having a head 66, stem 68, down-firing land 70, running-in groove 72, up-firing land 74, releasing groove 76, barrel 78, and terminal spigot 80; the barrel 78 has a slot 82 receiving a release shear pin 84 and is retained in its pre-firing position by No. 1 safety pin 86. The latching dogs 58 are positioned between the plunger 64 and the landing sleeve 50 and each comprise a lower head 88 having an outer portion **88*a* engageable with the recesses 56 and an inner portion 88*b* engageable with the plunger 64; and an upper head 90 having an inner portion 90*b* cooperating with the stem 68 of the plunger 64 and the down-firing land 70**.

(II)B The detonating piston and chamber assembly 38 comprises a piston housing 92 secured to the lower end of the plunger housing 60 and having a bore receiving a detonating piston 94 having a skirt 96 which forms an upper, hydrostatic pressure chamber 97, and a stem 98 which terminates in a detonating pin 100 and which extends from the lower face of the piston 94 and passes through a lower, atmospheric chamber 102 defined by the lower portion of said bore and said lower face of the piston 94. The seal between the piston 94 and the housing 92 is ensured by 0-rings 104; the hydrostatic pressure in the upper chamber 97 is communicated through the ports 54 and 62. The piston 94 is maintained in its pre-firing position against the pressure difference between well hydrostatic and atmospheric pressure by four releasing steel balls 106 which are held engaged in recesses in the housing 92 and apertures in the skirt 96 by the spigot 80 on the plunger 64; the piston 94 is further held in the pre-firing position by a No. 2 safety pin 108 which typically has a shearing value of 35.15 $kg/cm^2$ (500 psi) although this value can be increased as desired to suit different well conditions or requirements.

(II)C The detonator assembly 40 comprises a detonator housing 110 which is secured to the lower end of the piston housing 92 and the base of which receives a primary detonator 112 and a detonating charge 114.

The functioning of the detonating head 34 will now be briefly described.

The plunger 64 is the heart of the activating and releasing mechanism. With its arrangement of grooves and lands, it allows the dogs 58 of the latching mechanism to be retractive (running-in position) or to be secured in place (up- or down-firing positions). In its running-in position its lower end 80 keeps the releasing balls 106 in place, preventing the detonating piston 94 from moving downwards. The plunger 64 is kept in the running-in position by No. 1 safety pin 86. For the plunger 64 to move (up or down), this safety pin 86 must be sheared, either by pulling or by impact.

To retrieve the detonating head 34, the plunger 64 must be pulled upwards until the release shear pin 84 is sheared, allowing the latching dogs 58 to enter the plunger's releasing groove 76.

The detonating piston 94 is held in place by the set of four releasing steel balls 106 and then by No. 2 safety pin 108. Until the releasing balls 106 are moved out of position the piston 94 cannot move downwards, regardless of the hydrostatic pressure of the well 10. Once the releasing balls 106 have been moved, the hydrostatic pressure working on the area of the piston 94 must be greater than 35.15 $kg/cm^2$ (500 psi) in order to shear No. 2 safety pin 108, allowing the detonating piston 94 to move downwards.

When the detonating pin 100 strikes the primary detonator 112, it explodes, initiating the detonating charge which in turn produces a jet that perforates through the lower end of the detonator housing 110 and through the stinger cap 48, initiating the booster 46 contained in the stinger 42 and subsequently the perforators 24.

The retrievable firing head according to the present invention enables various operations to be performed, some of which will now be described.

(1) Running and Pull-firing Detonating Head with Slick-line or Wire Line

Perforating guns 24 (see FIG. 1) are run to the bottom of the well 10 attached to completion or testing string (18) by a tubing collar 115 and tubing pup joint 116 (FIG. 2) which has the stinger and landing sleeve assembly 32 screwed thereto. Positioned internally just above the pup joint 116 is a no-go-118.

Figure 4:
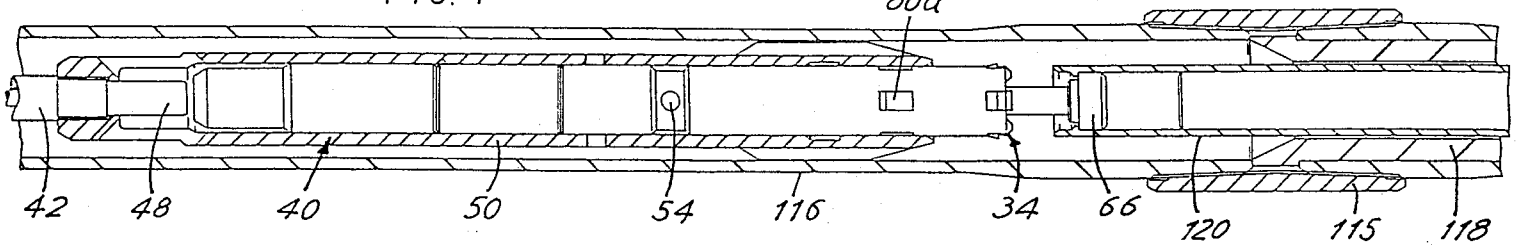
Figure 5:
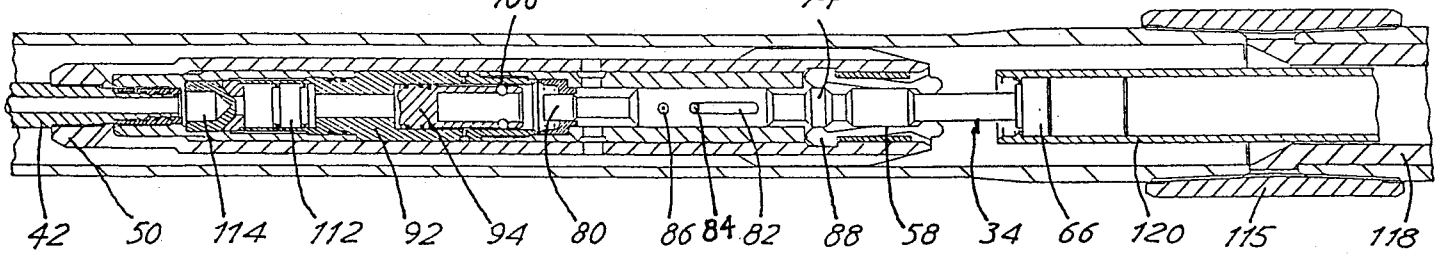

Once the perforating guns 24 are in position, the detonating head 34 is lowered by means of a wire pulling tool 120 to engage the stinger assembly 32 as shown in FIG. 2, after passing through the successive stages shown in FIGS. 4 and 5. During this lowering operation the running-in groove 72 of the plunger 64 is opposite the lower internal heads **88*b* of the latching dogs 58, thus allowing the dogs 58 to retract as the upper end of the detonating head 34 enters the landing sleeve 50 (FIG. 4). Fluids and solids are displaced through fill displacements ports 52 allowing the detonating head 34 to engage the stinger 42 and the external latching dog heads 90*a* to engage the internal annular recesses 56 in the landing sleeve 50. The detonating head 34** is thus secured in place.

To detonate the head 34, a straight pull is made on the plunger 64 which shears No. 1 safety pin 86, allowing the plunger 64 to move upwards to the FIG. 5 position at which it is halted by abutment of the release shear pin 84 against the lower end of the slot 82 and the releasing balls 106 to come out of their locked-in position, leaving the detonating piston 94 free to move downwards. The tubing hydrostatic pressure working against the atmospheric pressure of the atmospheric pressure chamber 102 moves the piston 94 downwards with enough force to give it a final impact of at least 1.11 kg-m (8 foot/lbs), the minimum force required to initiate the detonator 112 and shear No. 2 safety pin 108. Hence a minimum of 35.15 kg/cm$^2$ (500 psi) hydrostatic pressure in the hydrostatic chamber 97 is required to initiate the explosion.

At the same time, the latching dogs 58 are kept in place by the up-firing land 74 (FIG. 5) preventing the detonating head 34 from being blown out of the landing sleeve 50.

Figure 6:
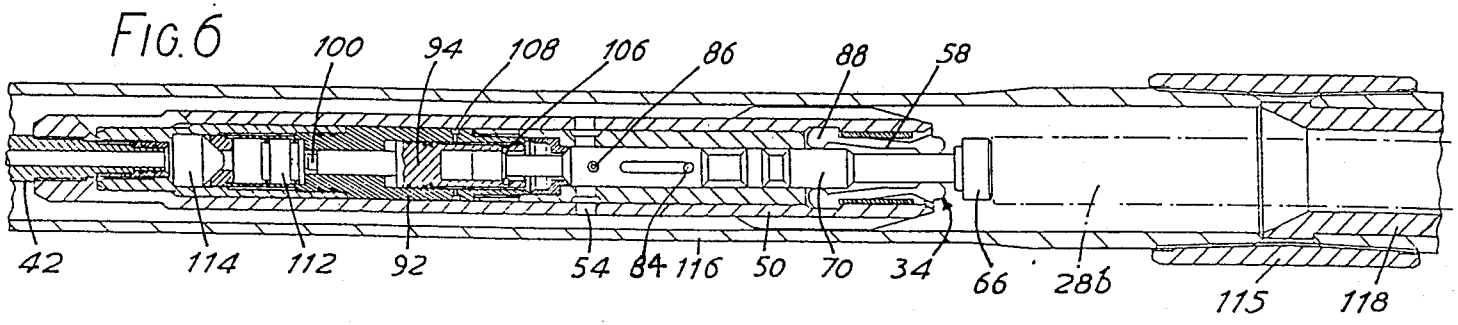
Figure 7:
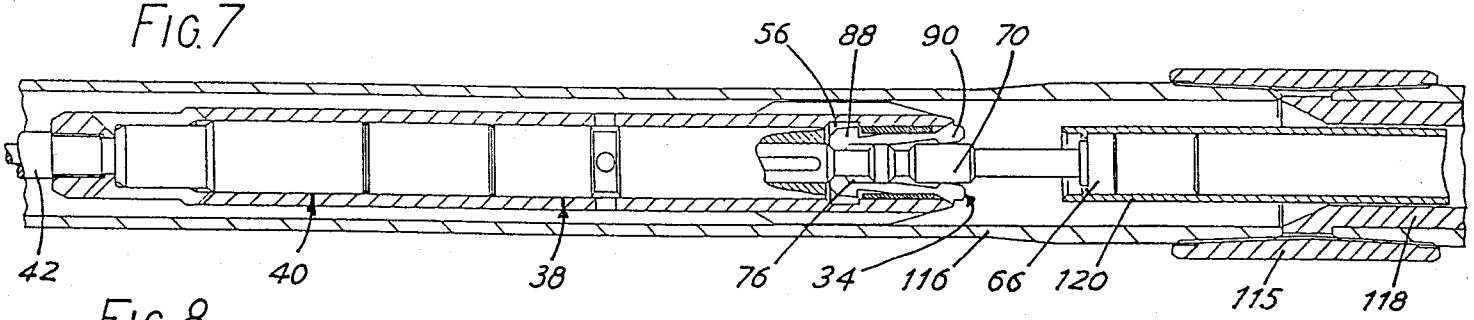
Figure 8:
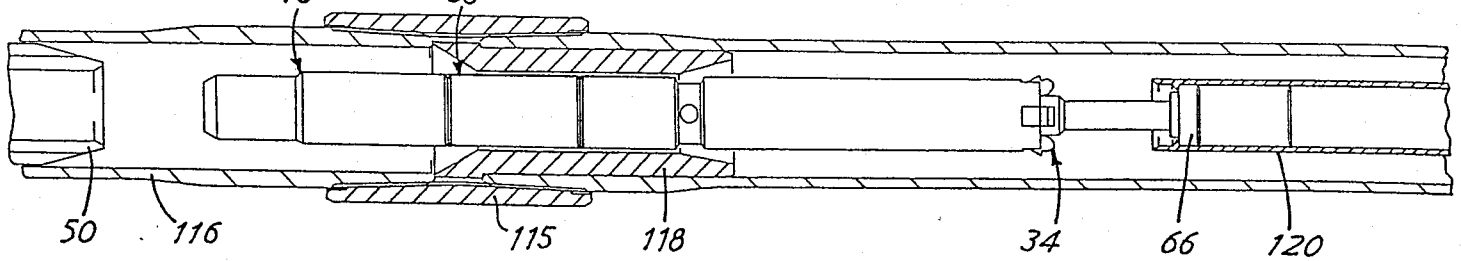

(2) Running Detonating Head with the Perforators and Firing it with Detonating Bar Instead of being run separately as in Operation (1), the detonating head 34 is latched into position in the landing sleeve 50 on the surface and the whole detonating head assembly run into the well with the perforating guns (see FIG. 1). A detonating bar 28 is then dropped from the surface and strikes the plunger 64 (dashed line position) with enough force to shear No. 1 safety pin 86 and allow the plunger 64 to move downwards to the FIG. 6 position at which it is arrested by the abutment of the shear pin 84 against the upper end of the slot 82 and the upper section of the piston housing 92. This movement of the plunger 64 causes the releasing balls 106 to move out of position, thus permitting the detonating piston 94 to move downwards under hydrostatic pressure as previously described. At the same time the down-firing land 70 keeps the latching dog heads **88*a* engaged in the recesses 56, thus preventing the detonating head from being blown out of the landing sleeve 50**.

(3) Firing with Detonating Bar run on Wireline

In an alternative procedure to that of Operation (2) the detonating bar 28 may be run on a wireline in controlled mode to a position say 7 metres above the plunger, and then struck down onto the plunger head 66. The consequent sequence of operations is of course the same.

(4) Retrieving Detonating Head after Firing

The wire line pulling tool 120 is run to engage the head 66 of the plunger 64 and to pull the plunger 64 up until the release shear pin 84 is sheared, allowing the plunger 64 to move into the releasing position. In this position the internal latching dog heads **88*b* face the releasing groove 76 and are caused to pivot thereinto, so that the external heads 88*a* are clear of the recesses 56, by the abutment of the down-firing land 70 against the upper latching dog heads 90**.

Once the lower dog heads **88*a* are clear of the recesses 56, the detonating head 34 may be pulled clear of the landing sleeve 50** and brought back to the surface for inspection.

Figure 9:
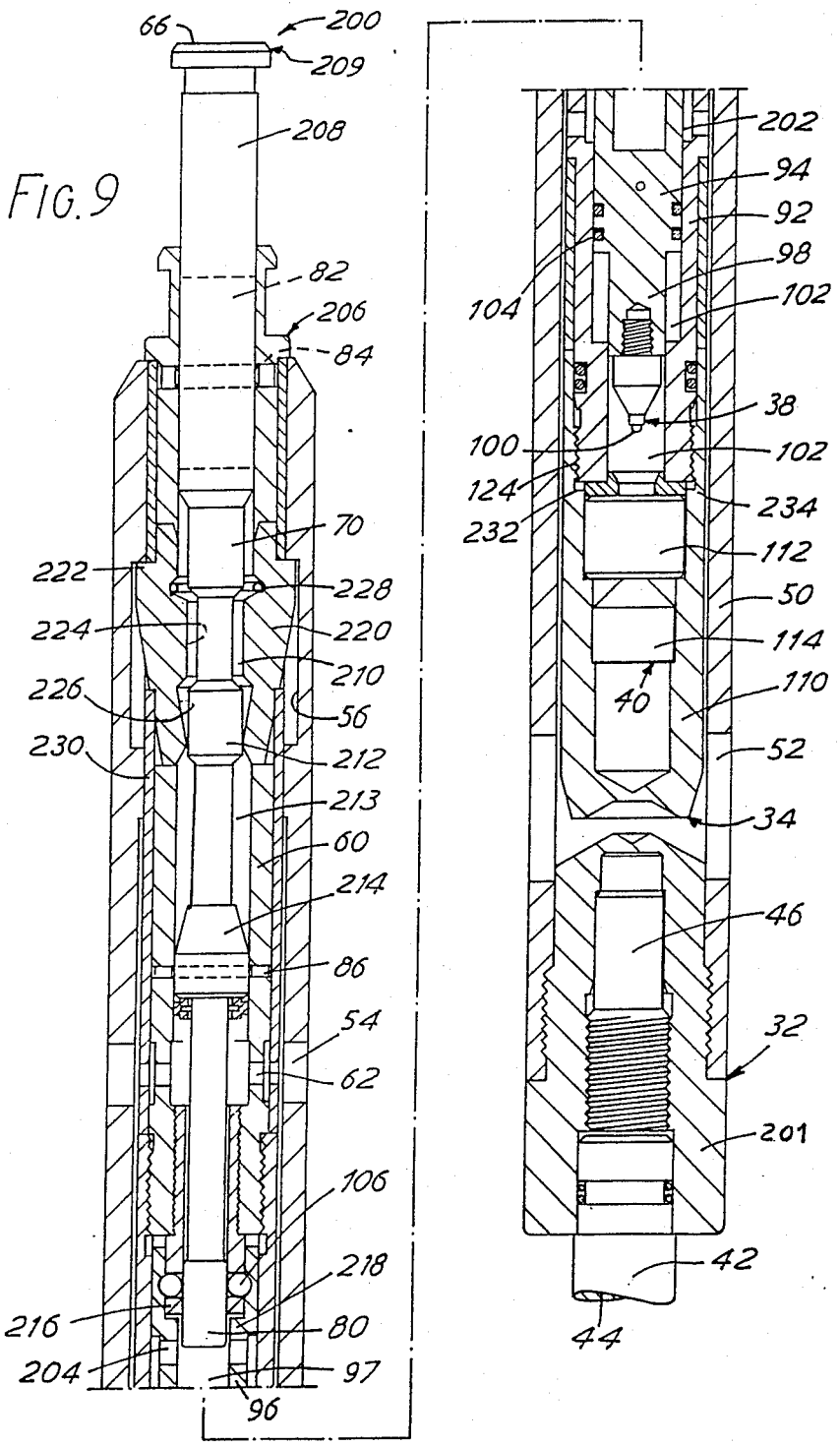
FIG. 9 is a longitudinal section through a second embodiment of the invention with the well casing omitted.

In FIG. 9 the same reference numerals have been used for parts which are the same as those in the first embodiment; however the second embodiment 200 of FIG. 9 differs from the first embodiment in several ways, as follows:

(1) The stinger 42 is connected to the landing sleeve 50 through a stinger head 201.

(2) A port 202 in the piston housing 92 and a communicating port 204 in the piston skirt 94 are provided to ensure that well hydrostatic pressure is maintained in the upper chamber 97.

(3) The latching mechanism and plunger assembly 206 differs in that the barrel 208 of the plunger 209 is located immediately under the plunger head 66, with the down-firing land 70 below it followed in turn by a longer running-in groove 210 and up-firing land 212; the releasing groove 213 is again longer and is bounded below by a boss 214 through which passes the No. 1 safety pin 86.

The releasing balls 106 are seated in recesses in the piston skirt 96 and rest on a shear pin 216 passing through the enlarged end of the spigot 80 and which projects just above a shoulder 218 formed in the skirt 96. The latching dogs 220 each comprise an upwardly facing shoulder 222 which cooperates with the upper radial face of the recess 56, and intermediate inner camming surface 224 and a lower inner camming surface 226; the dogs 220 are urged outwardly by a spring 228 and pivot about the top of a collar 230.

In FIG. 9 the detonating head 200 is shown just after having been run in. In the running-in condition the intermediate camming surfaces 224 are opposite the running-in groove 210 and the dogs 220 can thus retract inwardly as the upper end of the detonating head 200 enters the landing sleeve 50. Once the dogs 220 have passed the recesses 56, they spring radially outwards to the FIG. 9 position to prevent upward movement of the plunger housing 60 and the whole detonating assembly.

When the head 200 is detonated by the upward pulling on the plunger head 66 the No. 1 safety pin 86 is sheared, as is the No. 2 safety pin 216. The consequent upward movement of the plunger 209 allows the releasing balls 106 to fall into the chamber 97, and thus frees the piston 94 to initiate detonation in the manner previously described. The upward movement of the plunger 209 brings the up-firing land 212 opposite the intermediate camming surfaces 224, ensuring the maintenance of the dogs in the engagement position.

When the detonating head 200 is detonated by a detonating bar the shear pin 84 and safety pin 216 are sheared and the plunger 209 moves downwardly until its movement is arrested by the abutment of the boss 214 with the lower end of the plunger housing 60. The movement of the plunger 209 causes the releasing balls 106 to be dislodged and the down-firing land 70 to move opposite the intermediate camming surfaces 224 to maintain the latching dogs 220 in position.

When the detonating head 200 is retrieved by a wireline pulling tool the release shear pin 84 is sheared by jarring up and the boss 214 moves up to engage the lower camming surfaces 226 of the latching dogs 220 pivoting the shoulders 222 clear of the recesses 56, with the intermediate camming surfaces 224 entering the releasing groove 213 and allowing the head 200 to be retrieved.

(4) At the upper end of the detonator housing 110 in a position opposite the bottom of the internal thread 124 there are machined part-annular grooves 232 each leaving only a thin wall 234, constituting a pressure failure point in the detonator housing 110. The number, width and depth of the grooves 232 may be chosen to obtain a desired failure rating for the detonator housing 110 which may typically lie in the range of 211 to 1055 kg/cm$^2$ (3,000 to 15,000 psi).

If it is desired to de-activate the detonating head, a pressure of, say, 141 kg/cm$^2$ (2,000 psi) is applied to the top of the well 10 to cause the wall 234 to rupture and allow the pressure in the atmospheric chamber 102 to increase to well fluid pressure, thus equalizing the pressure differential in the chambers 97,102 and rendering the detonating piston 94 inoperable and the detonating head 200 much safer to handle.

It will be appreciated that various alterations may be made to the arrangements described above without departing from the scope of the invention as defined in the appended claims. Thus although the detonator head is described as being operable by hydrostatic pressure, this may be adapted for mechanical operation. For example where hydrostatic pressure is not available to actuate the detonating piston the arrangement may be modified to allow direct mechanical actuation thereof via the plunger after movement of the latter to free the releasing balls. Also, although the arrangement described only enables retrieval of the detonating head after firing, it can be adapted for retrieval before firing by arranging that the releasing balls can only be freed by downward motion of the plunger, e.g. by extending the lower part of the plunger that retains the balls in place.

I claim:

1. A detonating head for detonating one or more perforating guns suspended in an oil, gas or water well from a tubing string, comprising a firing member reciprocable therein and arranged to be driven to detonate a detonating assembly, restraining means for restraining the firing member against a driving force until the restraining means are disengaged, and a displaceable element which is arranged to be displaceable in either sense in the longitudinal direction of the detonating head to a respective firing position in which it disengages the restraining means.

2. A detonating head as claimed in claim 1, wherein said displaceable element is displaceable by mechanical actuation.

3. A detonating head as claimed in claim 1, in which said firing member is a piston reciprocable within a piston housing of said detonating head, the arrangement being such that said piston is drivable within said piston housing by well hdyrostatic pressure.

4. A detonating head as claimed in claim 3, and further comprising deactivating means which are actuable to apply equal hydrostatic pressure to each side of the piston.

5. A detonating head for detonating one or more perforating guns suspended in an oil, gas or water well from a tubing string, comprising a firing member reciprocable therein and arranged to be driven to detonate a detonating assembly, and retaining means for retaining the detonating head in position in relation to the tubing string against the force of detonation, the retaining means being releasable to allow the detonating head to be retrieved.

6. A detonating head as claimed in claim 5, further comprising restraining means for restraining the firing member against a driving force until the restraining means are disengaged and a displaceable element which is arranged to be displaceable in the longitudinal direction of the detonating head to a firing position in which it disengages the restraining means.

7. A detonating head as claimed in claim 6, wherein the releasable retaining means comprise a latch mechanism arranged to co-operate with an abutment on a landing sleeve within which the detonating head is receivable.

8. A detonating head as claimed in claim 6, wherein the releasable retaining means are arranged to be releasable by displacement of the longitudinally displaceable element to a withdrawal position by a force sufficient to overcome a predetermined resistance.

9. A detonating head as claimed in claim 8, in which the retaining means are arranged to be releasable by retraction of the element to a releasing position by a force sufficient to overcome said predetermined resistance.

10. A detonating head as claimed in claim 8, in which the restraining means are arranged to be disengaged by depression of the element to a down-firing position in which said element maintains the retaining means in operative condition by positive engagement.

11. A detonating head as claimed in claim 10, in which the restraining means are arranged to be disengaged by retraction of the element to an up-firing position, in which said element maintains the retaining means in operative condition by positive engagement.

12. A detonating head as claimed in claim 5, wherein the releasable retaining means comprise a latch mechanism arranged to co-operate with an abutment on a landing sleeve within which the detonating head is receivable.

13. A detonating head as claimed in claim 5, wherein the releasable retaining means are arranged to be releasable by displacement of the longitudinally displaceable element to a withdrawal position by a force sufficient to overcome a predetermined resistance.

14. A detonating head as claimed in claim 13, wherein the retaining means are arranged to be releasable by retraction of the element to a releasing position by a force sufficient to overcome said predetermined resistance.

15. A detonating head as claimed in claim 5, in which said firing member is a piston reciprocable within a piston housing of said detonating head, the arrangement being such that said piston is drivable within said piston housing by well hydrostatic pressure.

16. A detonating head as claimed in claim 15, and further comprising deactivating means which are actuable to apply equal hydrostatic pressure to each side of the piston.

* * * * *